United States Patent [19]

Najima et al.

[11] Patent Number: 4,508,620

[45] Date of Patent: Apr. 2, 1985

[54] METHOD OF AND APPARATUS FOR FEEDING AND DISCHARGING AIR FOR PNEUMATIC JIGS

[75] Inventors: Tetsuo Najima; Setsuya Tetsuta; Yukitaka Sawata; Masahiro Yamagishi, all of Yokohama, Japan

[73] Assignee: Mitsubishi Jukogyo Kabushiki Kaisha, Japan

[21] Appl. No.: 374,513

[22] Filed: May 3, 1982

[30] Foreign Application Priority Data

Nov. 10, 1980 [JP] Japan ..... 55-157846
Jan. 12, 1982 [JP] Japan ..... 57-2156[U]

[51] Int. Cl.[3] ..... B03B 5/24

[52] U.S. Cl. ..... 209/500; 209/502; 137/624.13

[58] Field of Search ..... 209/455–457, 209/500, 502, 425–427; 137/624.15, 624.13, 625.41, 625.46, 625.24, 624.18; 251/309–311

[56] References Cited

U.S. PATENT DOCUMENTS 3,650,295 3/1972 Smith ..... 137/624.15
4,127,480 11/1978 Aldick et al. ..... 209/502
4,176,749 12/1979 Wallace et al. ..... 209/500

FOREIGN PATENT DOCUMENTS 1156721 11/1963 Fed. Rep. of Germany ..... 209/457

OTHER PUBLICATIONS

"Theoretical Analysis of Air-Pulsed Jigs with New Pulsation System", Y. Sawada, Y. Jinnouchi & S. Kawashima, (Sep. 1982).

*Primary Examiner*—Frank W. Lutter
*Assistant Examiner*—Wm. Bond
*Attorney, Agent, or Firm*—McGlew and Tuttle

[57] ABSTRACT

A method of and apparatus for feeding and discharging air for pneumatic jigs, includes feeding and discharging pressure air to and from air chambers, which are opened at their respective lower ends, and which are formed in water-filled tanks, to vertically vibrate water in the water tanks, and separate a pulverulent body on the water. The air feeding and discharging steps are carried out repeatedly, and with having overlapping periods. The apparatus comprises an outer cylindrical casing, and an inner casing provided rotatably in the outer casing, the outer casing being provided in a circumferential wall thereof with a communication port communicated with air pipes opened into the air chambers. A plurality of air ports communicate with an air feeding unit which is capable of feeding air of a plurality of different pressures to the air chambers, and a discharge port is provided. The air ports and discharge port are spaced from one another in the direction of the axis of the outer casing, the inner casing being provided with communication ports in those portions of the circumferential wall thereof which correspond to the air ports and discharge port and which are spaced in the direction of the axis thereof.

9 Claims, 22 Drawing Figures

PATTERN OF FEEDING AND DISCHARGING OF AIR

METHOD OF AND APPARATUS FOR FEEDING AND DISCHARGING AIR FOR PNEUMATIC JIGS

BACKGROUND OF THE INVENTION

This invention relates to a method of and an apparatus for feeding and discharging air to and from a pneumatic jig, which is used to separate a pulverulent body in accordance with the differences in the specific gravity of particles thereof.

First, a pneumatic jig will be described with reference to FIGS. 1 and 2. Partitions 2 provided in a casing 1 defines therein a plurality of water tanks 3, each of which is provided with an air chamber 4 therein. A reticulate member 5 is provided at upper portions of the water tanks 3, and a feed port 6 for a pulverulent body at an upper portion of one end of the casing 1, discharge ports 7, 8 for lighter and heavier pulverulent bodies, respectively, being provided in a vertically adjoined state at an upper portion of the other end thereof. Each of the air chambers 4 is provided therein with an air pipe 9 extended therethrough from the outside of the casing 1, while each of the water tanks 3 is provided at a lower portion thereof with a water pipe 10 extended therethrough from the outside of the casing 1.

Water is stored in each of the water tanks 3. A pulverulent body is fed from the feed port 6 onto the reticulate member 5. The pressure air is fed and discharged periodically to and from the air chambers 4 through the air pipes 9. Owing to the periodical feeding and discharging of the pressure air, the water-level in the water tanks 3 is displaced up and down repeatedly. Such vertical displacement of the water-level cause the pulverulent body, which has been fed from the feed port 6 onto the reticulate member 5, to be moved vertically as it is agitated. Consequently, the pulverulent body is stratified or separated into an upper layer consisting of particles thereof having a lower specific gravity, and a lower layer consisting of particles thereof having a higher specific gravity. The stratified pulverulent body is moved from the feed port 6 toward a downstream end of the casing 1. Such particles of the pulverulent body that have a lower specific gravity are recovered from the upper discharge port 7 with the overflowing water, while such particles thereof that have a higher specific gravity are moved on the reticulate member 5 to be recovered from the discharge port 8.

While the above-described operation is repeated continuously, the pulverulent body, which is fed from the feed port 6, is separated into particles having a lower specific gravity and particles having a higher specific gravity. In order to prevent the quantity of water in the water tanks 3 from decreasing below a predetermined level, the water is supplied thereto constantly through the water pipes 10.

In order to feed and discharge pressure air to and from the air chambers 4 in the above pneumatic jig through the air pipes 9, an air feeding and discharging apparatus shown in FIGS. 3 and 4 has heretofore been used.

Referring to FIGS. 3 and 4, an air feed port 12 and an air discharge port 13, which are communicated with a pressure air feeding means (not shown), are provided in those portions of a circumferential wall of an outer cylindrical casing 11 which are opposed to each other. A communication port 14, which is communicated with the air pipes 9 shown in FIGS. 1 and 2, is provided at a lower portion of the outer casing 11. Inside the outer casing 11, an inner cylindrical casing 15, which is rotated at a constant speed by a drive means (not shown), is provided. The outer surface of the inner casing 15 and the inner surface of the outer casing 11 are air-tightly formed. The inner casing 15 is opened at both ends thereof, so that the interior thereof and the communication port 14 are communicated with each other. The inner casing 15 is provided with a communication port 16 in a circumferential wall thereof. Reference numerals 17, 18 denote slide gates for use in regulating the areas of the air feed and discharge ports 12, 13.

When the inner casing 15 is rotated to allow the communication port 16 to be opposed to the air feed port 12, the pressure air flows into the interior of the inner casing 15 through the air feed port 12 and communication port 16. The pressure air then flows from the interior of the inner casing 15 to the communication port 14 through both end portions of the former. The pressure air then flows from the communication port 14 into the air chambers 4 through the air pipes 9.

When the inner casing 15 further continues to be rotated, the air feed port 12 is closed with the outer surface thereof, so that the pressure air stops flowing into the inner casing 15. When the inner casing 15 further continues to be rotated, the communication port 16 is opposed to the discharge port 13. When the communication port 16 is opposed to the discharge port 13, the air in the air chambers 4 flows from both end portions of the inner casing 15 thereinto through the air pipes 9 and communication port 14. The resulting air is discharged to the atmosphere through the communication port 16 and discharge port 13.

The air is thus fed and discharged alternately to and from the air chambers 4. The pressure in the air chambers 4 is increased and decreased in accordance with upwardly extending mountain-shaped sine curves shown in FIG. 5*a*, while the water in the water tanks 3 is vibrated in accordance with a sine curve shown in FIG. 5*b*, which waves in a staggered manner with respect to the sine curves shown in FIG. 5*a*. However, when the water is vibrated in such a manner, the pulverulent body fed onto the reticulate member 5 receives either the upward or downward force of water at all times in a substantially equal manner, so that the time necessary for the pulverulent body to fall freely and thereby promote the separation thereof is too short. This causes a decrease in the separation efficiency of the pulverulent body.

SUMMARY OF THE INVENTION

A first object of the present invention is to provide a method of and an apparatus for feeding and discharging air for pneumatic jigs, which is free from the above-mentioned drawbacks encountered in the conventional method and apparatus of this kind, and which has an improved pulverulent body-separating efficiency.

A second object of the present invention is to provide an apparatus for feeding and discharging air for pneumatic jigs, which has an improved pulverulent body-separating efficiency, and which permits minimizing equipment cost and saving operating power.

To these ends, the present invention provides a method of feeding and discharging air for pneumatic jigs, having the steps of feeding and discharging pressure air to and from air chambers, which are opened at their respective lower ends, and which are formed in water-filled tanks, to vertically vibrate the water in the water tanks, and thereby separate the pulverulent body, comprising a plurality of steps of feeding pressure air to the air chambers, and a step of discharging the air from the same air chambers, the air feeding steps and air discharging step being carried out repeatedly. An apparatus for feeding and discharging air for pneumatic jigs is also provided, in which pressure air is fed and discharged to and from air chambers, which are opened at their respective lower ends, and which are formed in water-filled tanks, to vibrate the water in the water tanks and thereby separate a pulverulent body, comprising an outer cylindrical casing, and an inner casing provided rotatably in the outer casing, the outer casing being provided in a circumferential wall thereof with a communication port communicated with air pipes opened into the air chambers, a plurality of air ports communicated with an air feeding means, and a discharge port. An apparatus is also provided and discharging air for pneumatic jigs, in which pressure air is fed and discharged to and from air chambers, which are opened at their respective lower ends, and which are formed in water-filled tanks, comprising a plurality of outer cylindrical casings, communication ports provided in circumferential walls of the outer casings and communicated with air pipes opened into the air chambers, a discharge port provided in the circumferential wall of one of the outer casings, air ports provided in the circumferential walls of the outer casings and communicated with an air feeding means, inner cylindrical casings provided rotatably in the outer casings and operatively connected to one another, the interior of each of which inner casings is communicated with the corresponding communication ports, and communication ports provided in circumferential walls of the inner casings further apparatus of the invention for feeding and discharging air for pneumatic jigs, comprises a tank for storing high-pressure air, means for sending high-pressure air to the air tank, a plurality of air feed pipes connected to the air tank, a pressure regulating valve provided in at least one of the air feed pipes, and another air tank provided on the downstream side of the pressure regulating valve, the air feed pipes being connected at their respective ends to air ports provided in an outer casing of the apparatus.

In the method according to the present invention, a plurality of air feeding steps are carried out repeatedly. Namely, high-pressure air is initially fed to the air chambers to increase the air pressure therein to a maximum level, and cause the water therein to be pressed downward suddenly by the air pressure, so that the water-level in the water tanks becomes high suddenly. As the water-level in the water tank becomes high, the air pressure in the air chambers is decreased. At around such time that the water-level in the water tanks becomes highest, low-pressure air is fed to the air chambers. As a result, the air pressure in the air chambers is increased to a small extent. At this time, the water flows into the air chambers in accordance with a decrease in the water-level in the water tanks but the flow rate of the water is low owning to the low-pressure air fed to the air chamber. Accordingly, the water-level in the water tanks is decreased little by little. Therefore, while the water-level in the water tanks is decreased little by little, the pulverulent body falls freely, and is separated into a layer of lighter particles and a layer of heavier particles. An air-discharging step is then carried out to discharge the air from the air chambers, the air pressure in which is in a high level. Accordingly, the water-level in the water tanks is decreased not suddenly but gradually. According to the present invention, the water-level in the water tanks is increased suddenly in one cycle of air feeding operation, and decreased gradually at a substantially constant rate. This allows the pulverulent body to fall freely, and the pulverulent body-separating efficiency to be increased. Also, according to the present invention, an increase in the pulverulent body-separating efficiency can be attained by using the apparatus described above, which permits minimizing the equipment cost, and saving the operating power.

The above objects, features and advantages of the present invention will become more apparent from the following description of the preferred embodiments taken in conjunction with the accompanying drawings.

DESCRIPTION OF THE PREFERRED EMBODIMENTS

Figure 1:
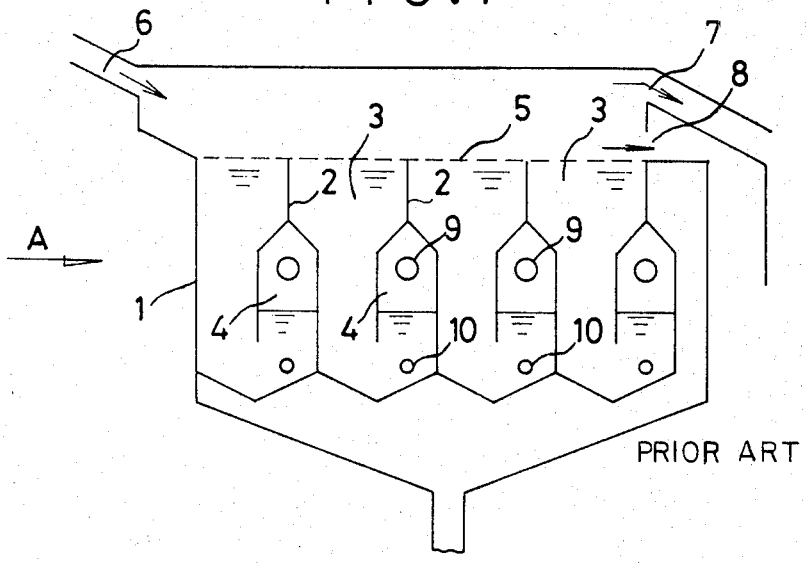
FIG. 1 is a front elevational view in section of a pneumatic jig.
Figure 2:
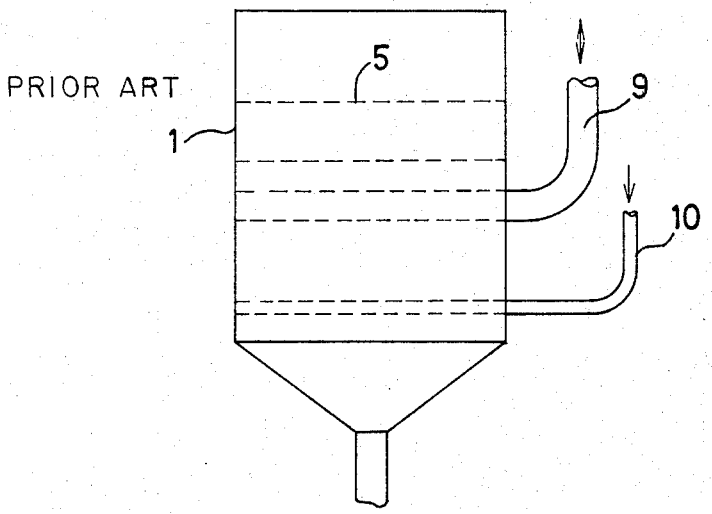
FIG. 2 is a side elevational view taken from the side of an arrow A.
Figure 3:
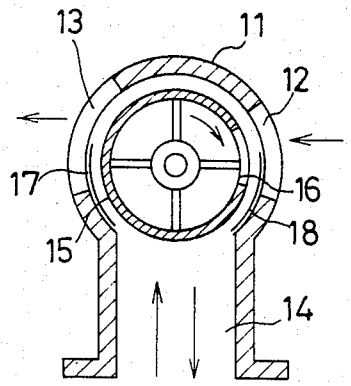
PRIOR ART FIG. 3
FIG. 3 is a side elevational view in section of a conventional apparatus for feeding and discharging air for pneumatic jigs.
Figure 4:
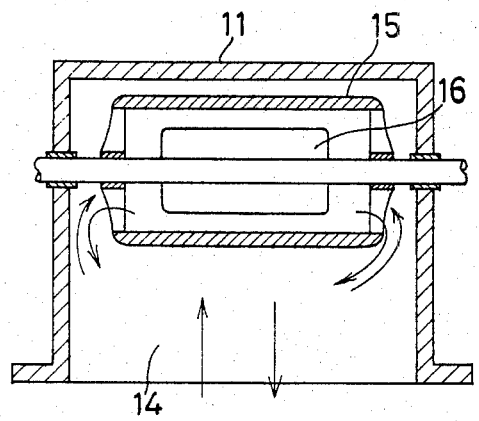
PRIOR ART FIG. 4
FIG. 4 is a front elevational view in section of the apparatus shown in FIG. 3.
Figure 5:
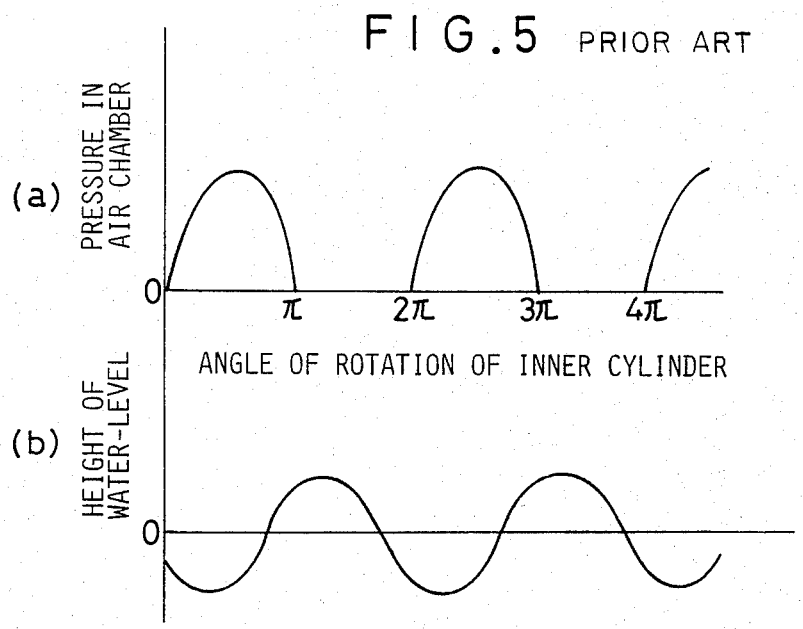
FIG. 5 PRIOR ART
FIG. 5 at (*a*) is a graph showing the distribution of pressure in air chambers, to and from which pressure air is fed and discharged by the conventional air feeding and discharging apparatus, and at (*b*) is a graph showing variations in the water-level with respect thereto.
Figure 6:
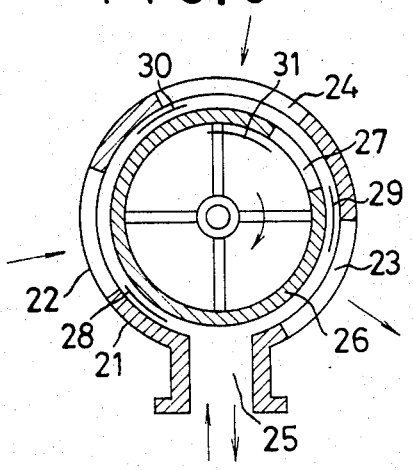
FIG. 6 is a side elevational view in section of a first embodiment of the present invention.

The present invention will now be described in detail with reference to the first embodiment thereof shown in FIG. 6.

An outer cylindrical casing 21 is provided in a circumferential wall thereof with a feed port 22 for high-pressure air, which is communicated with a pressure air feeding means (not shown), a discharge port 23, a feed port 24 for low-pressure air, and a communication port 25 communicated with air pipes 9. The outer casing 21 is also provided in the interior thereof with an inner cylindrical casing 26 adapted to be rotated at a constant speed by a drive means (not shown). The outer surface of the inner casing 26 and the inner surface of the outer casing 21 are formed air-tightly with respect to each other. The inner casing 26 is opened at both ends thereof, and the interior thereof is communicated with the communication port 25. The inner casing 26 is provided with a communication port 27 in a circumferential wall thereof. Reference numerals 28, 29, 30, 31 denote slide gates for regulating the cross-sectional areas of the feed ports 22 for high-pressure air, discharge port 23, feed port 24 for low-pressure air, and communication port 27, respectively. The feed port 22 for high-pressure air, feed port 24 for low-pressure air, and discharge port 23 are so formed with respect to a circular cross section of the outer casing 21 that the centers of the feed ports 22, 24 are spaced at an angle of rotation of 100°; the centers of the feed port 24 and discharge port 23 at an angle of rotation of 115°; and the centers of the discharge port 23 and feed port 22 at an angle of rotation of 145°.

The inner casing 26 is rotated at 27–55 rpm. When the communication port 27 is opposed to the feed port 22, high-pressure air of 0.5–0.7 kg/cm$^2$ flows into the inner casing 26 through the feed port 22 and communication port 27, and the air then flows from the interior of the inner casing 26 to the communication port 25 through end portions thereof. The air further flows from the communication port 25 into the air pipes 9 to enter the air chambers 4. When the inner casing 26 is further rotated, the feed port 24 and communication port 27 are opposed to each other, low-pressure air of 0.2–0.4 kg/cm$^2$ flows into the inner casing 26 through these ports 24, 27. The air then enters the air chambers 4 in the same manner as the high-pressure air. When the inner casing 26 is further rotated to cause the communication port 27 to be opposed to the discharge port 23, the air in the air chambers 4 flows through the air pipes 9 and communication port 25 to enter the inner casing 26 from end portions thereof. The air is then discharged from the discharge port 23 through the communication port 27.

Figure 7:
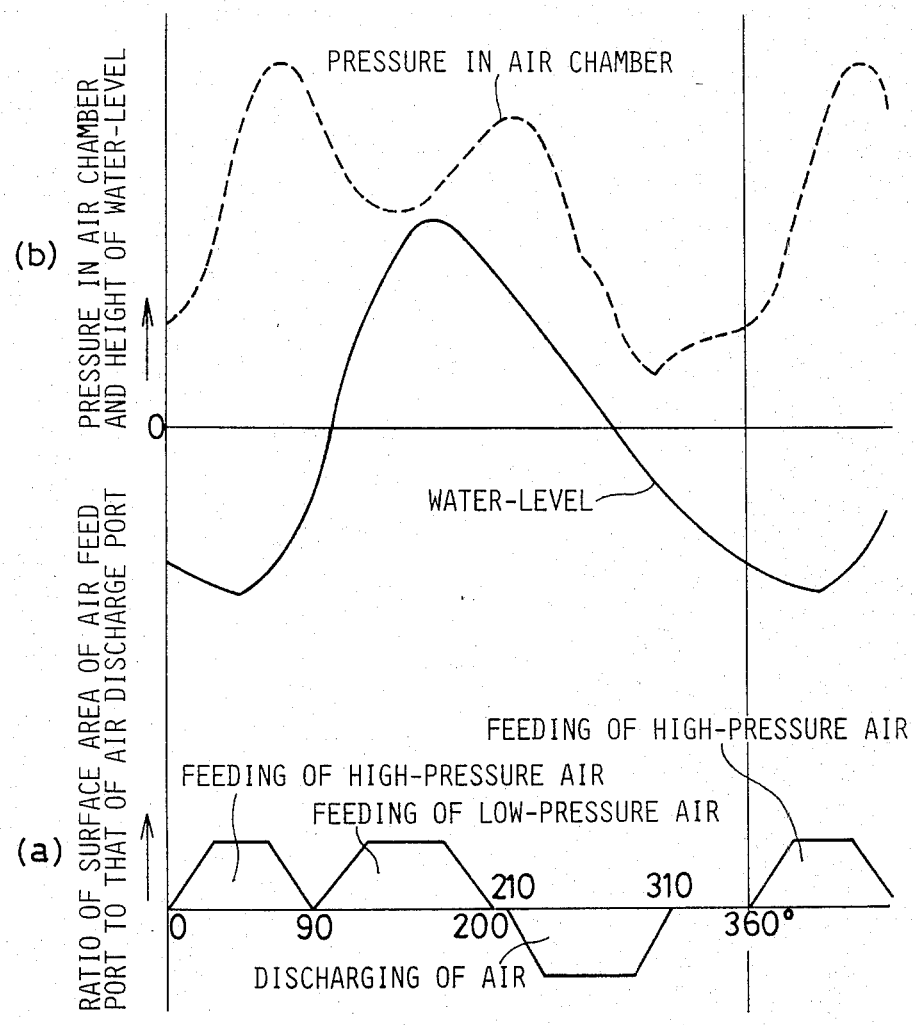
FIG. 7 at (*a*) is a graph showing the pattern of the feeding and discharging of air by the apparatus according to the present invention, and at (*b*) is a graph showing the distribution of pressure in the air chambers and variations in the water-level with respect thereto.

The feeding of high-pressure air, the feeding of low-pressure air, and the discharging of the air, shown in FIG. 7*a*, are carried out in the mentioned order repeatedly by the above-described apparatus. Consequently, the pressure in the air chambers 4 is increased and decreased as shown in broken line in FIG. 7*b*, i.e. slightly later than the instants at which the air starts being fed and discharged. Owing to an increase in the pressure in the air chambers 4, the water-level in the water tanks is increased suddenly as shown in full line in FIG. 7*b*. When the water-level has attained the highest point, it is decreased gradually at a substantially constant rate. Accordingly, the pulverulent body receives the upward force but substantially not the downward force. The pulverulent body thus falls freely. This allows the efficiency of the apparatus of separating the pulverulent body into a layer of lighter particles and a layer of heavier particles to be increased.

Figure 8:
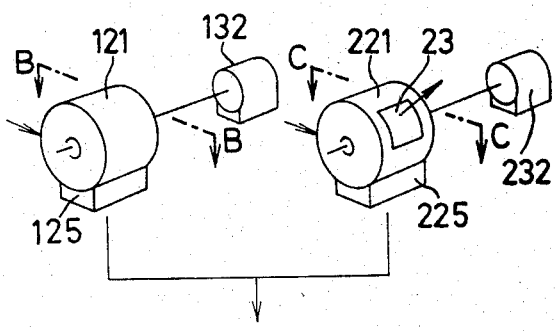
FIG. 8 is a perspective view of a second embodiment of the present invention.
Figure 9:
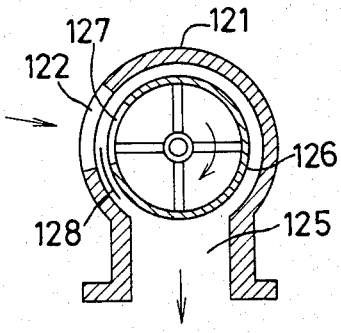
FIGS. 9 and 10 are sectional views taken along the lines B—B and C—C, respectively, in FIG. 8.
Figure 10:
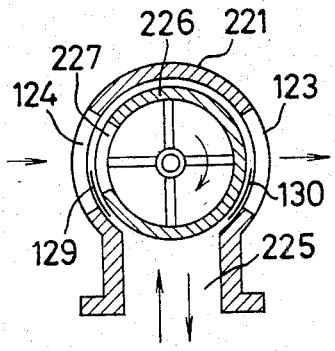

A second embodiment shown in FIGS. 8–10 will be described. Two outer casings 121, 221 are provided. One outer casing 121 is provided in a circumferential wall thereof with a feed port 122 for high-pressure air, which is communicated with a high-pressure air feeding means, and a communication port 125, which is communicated with the air pipes 9. The outer casing 121 is also provided in the interior thereof with an inner cylindrical casing 126, which is adapted to be rotated at a constant speed by a drive means 132. The outer surface of the inner casing 126 and the inner surface of the outer casing 121 are formed air-tightly with respect to each other. The inner casing 126 is opened at both ends thereof. The interior of the inner casing 126 and the communication port 125 are communicated with each other. The inner casing 126 is provided with a communication port 127 in the circumferential wall thereof. The other outer casing 221 is provided in a circumferential wall thereof with a feed port 124 for low-pressure air, which is communicated with a low-pressure air feeding means, a discharge port 123, and a communication port 225 communicated with the air pipes 9. The outer casing 221 is also provided in the interior thereof with an inner cylindrical casing 226, which is adapted to be rotated at a constant speed by a drive means 232. The outer surface of the inner casing 226 and the inner surface of the outer casing 221 are formed air-tightly. The inner casing 226 is opened at both ends thereof, and the interior of the inner casing 226 and communication port 225 are communicated with each other. The inner casing 226 is provided with a communication port 227 in a circumferential wall thereof.

The inner casings 126, 226 are rotated at the same speed by the drive means 132, 232, respectively. The embodiment is so constructed that, after the central portions of the feed port 122 for high-pressure air and communication port 127 have been opposed to each other, the centers of the feed port 124 for low-pressure air and communication port 227 are opposed to each other at a phase lag of 100°. The discharge port 123 is so formed that the center thereof has a phase lag of 115° with respect to that of the feed port 124. Reference numerals 128, 129, 130 denote slide gates for regulating the areas of the feed ports 122, 124 and discharge port 123, respectively.

The air feeding and discharging operations of this embodiment and the effect thereof are the same as those of the first embodiment, and the description of the matter will be omitted.

Figure 11:
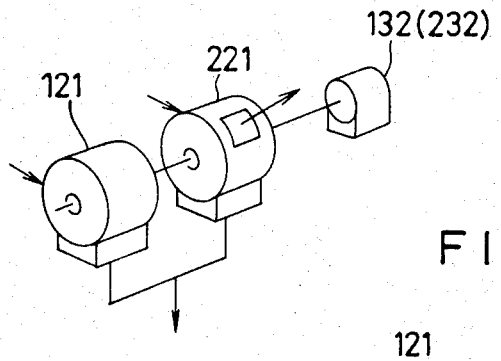
FIG. 11 is a perspective view of a third embodiment of the present invention.
Figure 12:
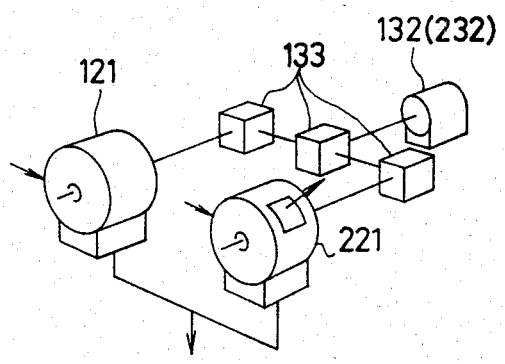
FIG. 12 is a perspective view of a fourth embodiment of the present invention.

The second embodiment described above is formed with two each of inner and outer casings and two drive means. The apparatus may be formed as shown in FIG. 11, in which a single drive means 132 (232) is used, to a rotary shaft of which two inner casings are connected in series. The apparatus may also be formed as shown in FIG. 12, in which a single drive means 132 (232) is used, a rotary shaft of which is connected to rotary shafts of parallel-arranged inner casings via power transmission units 133. In addition, the discharge port 123 may be provided in that portion of the outer casing 121 which is on the side of the feed port 122 for high-pressure air.

Figure 13:
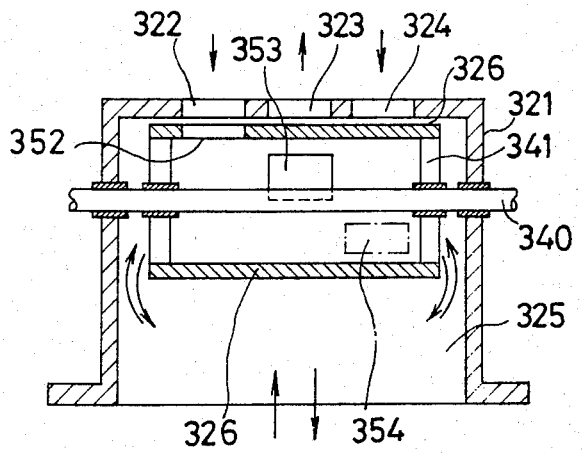
FIG. 13 is a front elevational view in section of a fifth embodiment of the present invention.
Figure 14:
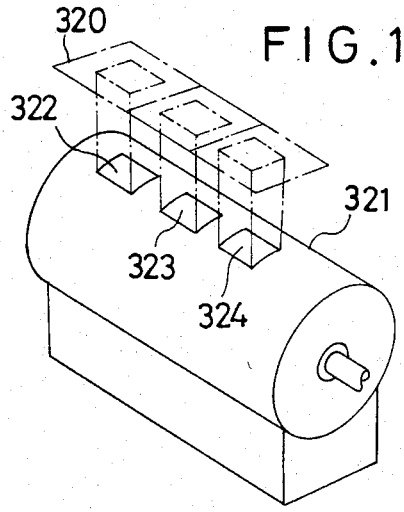
FIG. 14 is a perspective view of the embodiment shown in FIG. 13.
Figure 15:
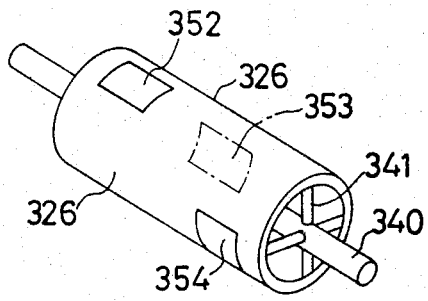
FIG. 15 is a perspective view of an inner casing of the embodiment shown in FIG. 13.
Figure 16:
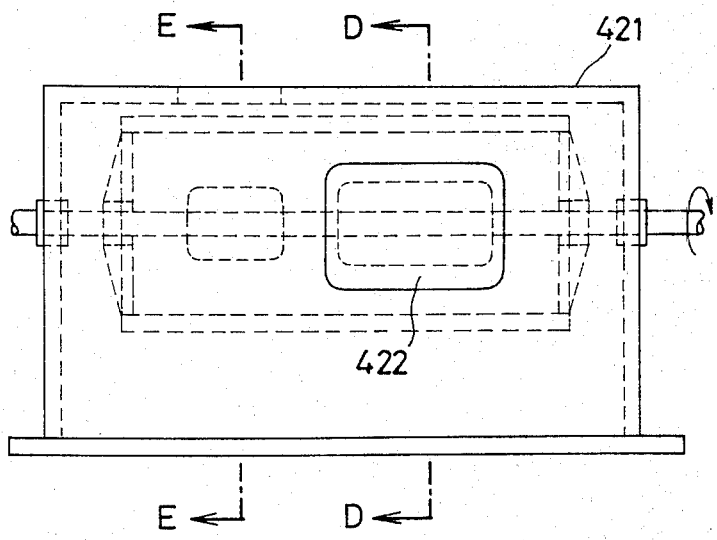
FIG. 16 is a front elevational view of a sixth embodiment.
Figure 17:
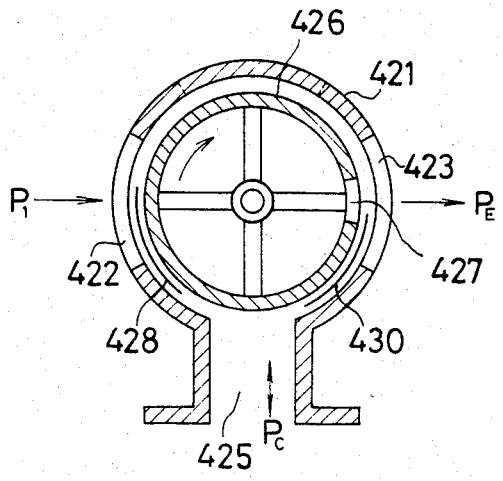
FIGS. 17 and 18 are sectional views taken along the lines D—D and E—E, respectively, in FIG. 16.
Figure 18:
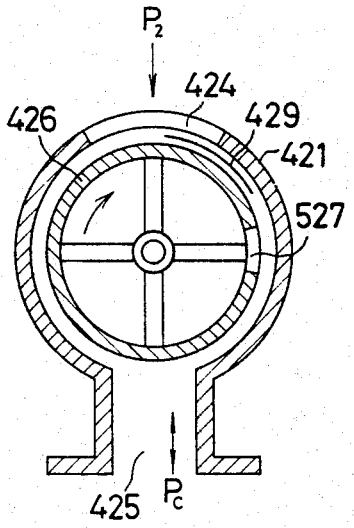
Figure 19:
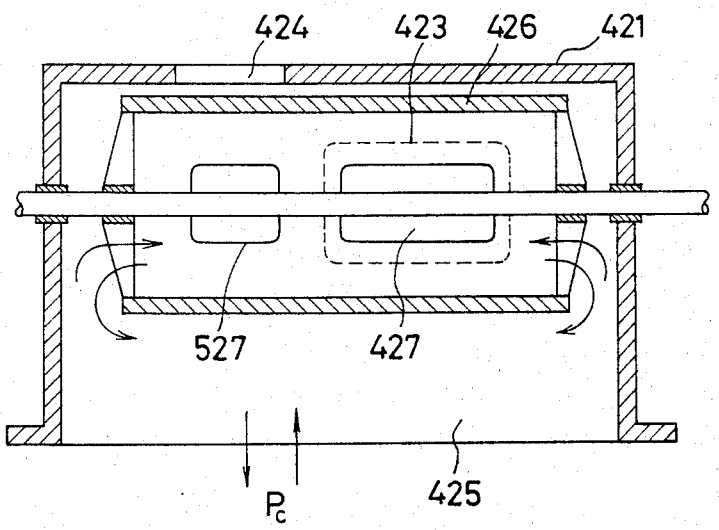
FIG. 19 is a front elevational view in longitudinal section of the embodiment shown in FIG. 16.

FIGS. 13–15 show still another embodiment. Referring to FIG. 13, reference numeral 321 denotes an outer casing, which is provided in a circumferential wall thereof with a feed port 322 for high-pressure air, a discharge port 323, and a feed port 324 for low-pressure air, which are aligned in the direction of the axis of the outer casing 321. The feed ports 322, 324 are connected via pipes to air feeding means (not shown), i.e. a high-pressure air source and a low-pressure air source, respectively. The discharge port 323 is opened to the atmosphere via a pipe. In this embodiment, the ports lined up as mentioned above may be communicated with the air sources and atmosphere via a flange 320 in the manner illustrated in FIG. 14. The outer casing 321 is provided just as the outer casing of a conventional air feeding and discharging apparatus with a communication port 325 for communicating the outer casing with the air chambers 4 in a pneumatic jig via the air pipes 9. Reference numeral 326 denotes an inner casing provided rotatably in the outer casing 321 in the same manner as the inner casing of a conventional air feeding and discharging apparatus. The inner casing 326 is mounted via a plurality of support rods 341 on a shaft 340 rotatably supported on front and rear walls of the outer casings 321. As shown in FIG. 15, the inner casing 326 is provided in a circumferential wall thereof with three ports extending in the direction of the axis thereof, i.e. a feed port 352 for high-pressure air, which is positioned correspondingly to the feed port 322 mentioned above in the outer casing 321, a discharge port 353 positioned correspondingly to the discharge port 323, and a feed port 354 for low-pressure air, which is positioned correspondingly to the feed port 324 for low-pressure air. The inner casing 326 is adapted to be rotated at a predetermined speed in a predetermined direction by a driving power source (not shown). Each of the ports 322, 323, 324 in the outer casing 321 is provided on the inside thereof with a slide gate (not shown) just as the ports similar thereto in the outer casing of a conventional apparatus of this kind, which slide gates are used to regulate the timing of air feeding and discharging operations.

This embodiment is constructed as mentioned above. When an operation of the pneumatic jig is started, the inner casing 326 is rotated in a predetermined direction. As the inner casing 326 is rotated, the feed port 352 therein for high-pressure air is opposed to the feed port 322 for high-pressure air in the outer casing 321. Consequently, the high pressure air from a high-pressure air source flows into the inner casing 326 through the feed ports 322, 352. The air then enters the air chambers 4 in the pneumatic jig through the communication port 325. When the inner casing 326 is further rotated, so that the feed port 324 for low-pressure air in the outer casing 321 and the feed port 354 for low-pressure air in the inner casing 326 are opposed to each other, the low-pressure air from a low-pressure air source flows into the air chambers 4 through the feed ports 324, 354 in the same manner as the high-pressure air. When the inner casing 326 is still further rotated, the discharge port 353 therein is opposed to the discharge port 323 in the outer casing 321. Consequently, the air in the air chambers 4 in the pneumatic jig flows into the inner casing 326 from the openings at both ends thereof through the communication port 325. The air is then discharged to the outside through the discharge ports 353, 323. This embodiment, the construction and operation of which have been described above, has the same effect as the embodiments previously described. In this embodiment, the feed port 322 for high-pressure air, discharge port 323, and feed port 324 for low-pressure air in the outer casing 321 are arranged in a circumferential wall thereof in such a manner that these ports 322, 323, 324 are lined up in the direction of the axis of the outer casing 321. Accordingly, these ports 322, 323, 324 can be formed very easily. Moreover, these ports 322, 323, 324 arranged in a row can be communicated with the high-pressure air source, atmosphere, and low-pressure source, respectively, via the flange 320, so that the overcrowding of connecting pipes can be prevented. Thus, this embodiment has an excellent practical effect.

FIGS. 16–19 show a further embodiment of the present invention. In this embodiment, primary and secondary air feeding ports 422, 424, which are communicated with an air feeding means (not shown), a discharge port 423, and a communication port 425, which is communicated with the air pipes 9, are provided in a circumferential wall 421 of an outer cylindrical casing 421. The outer casing 421 is further provided in the interior thereof with an inner cylindrical casing 426 adapted to be rotated at a constant speed by a drive means (not shown). The outer surface of the inner casing 426 and the inner surface of the outer casing are formed airtightly with respect to each other. The inner casing 426 is opened at both ends thereof, and the interior thereof and communication port 425 are communicated with each other. The inner casing 426 is provided in a circumferential wall thereof with communication ports 427, 527. Reference numeral 428, 429, 430 denote slide gates for regulating the areas of the primary feed port 422, secondary feed port 424 and discharge port 423, respectively. The positional relation between the feed and discharge ports and communication ports is as shown in FIGS. 16–19. Namely, the primary feed port 422 and discharge port 423 are formed in those portions of the circumferential wall of the outer casing 421 which are in the same cross section thereof and which are substantially opposite to each other with respect to the axis thereof. The communication port 427 in the inner casing 426 is provided in that cross section thereof which is aligned with the cross section of the outer casing 421, in which the ports 422, 423 are provided. While the inner casing 426 is rotated, the communication port 427 is opposed to the primary feed port 422 and discharge port 423 alternately to open and close the air feeding and discharging apparatus repeatedly. The secondary feed port 424, the area of which is smaller than that of the primary feed port 422, is provided in a peripheral portion of that cross section of the outer casing 421 which is spaced in the direction of the axis thereof from the cross section thereof in which the port 422 is provided. The secondary feed port 424 is positioned at a different phase with respect to the primary feed port 422 (the secondary feed port 424 in this embodiment has a 90° phase difference with respect to the primary feed port 422). The inner casing 426 is further provided in a peripheral portion of that cross section thereof in which the secondary feed port 424 is formed, with a communication port 527, which is in alignment with the communication port 427.

Figure 20:
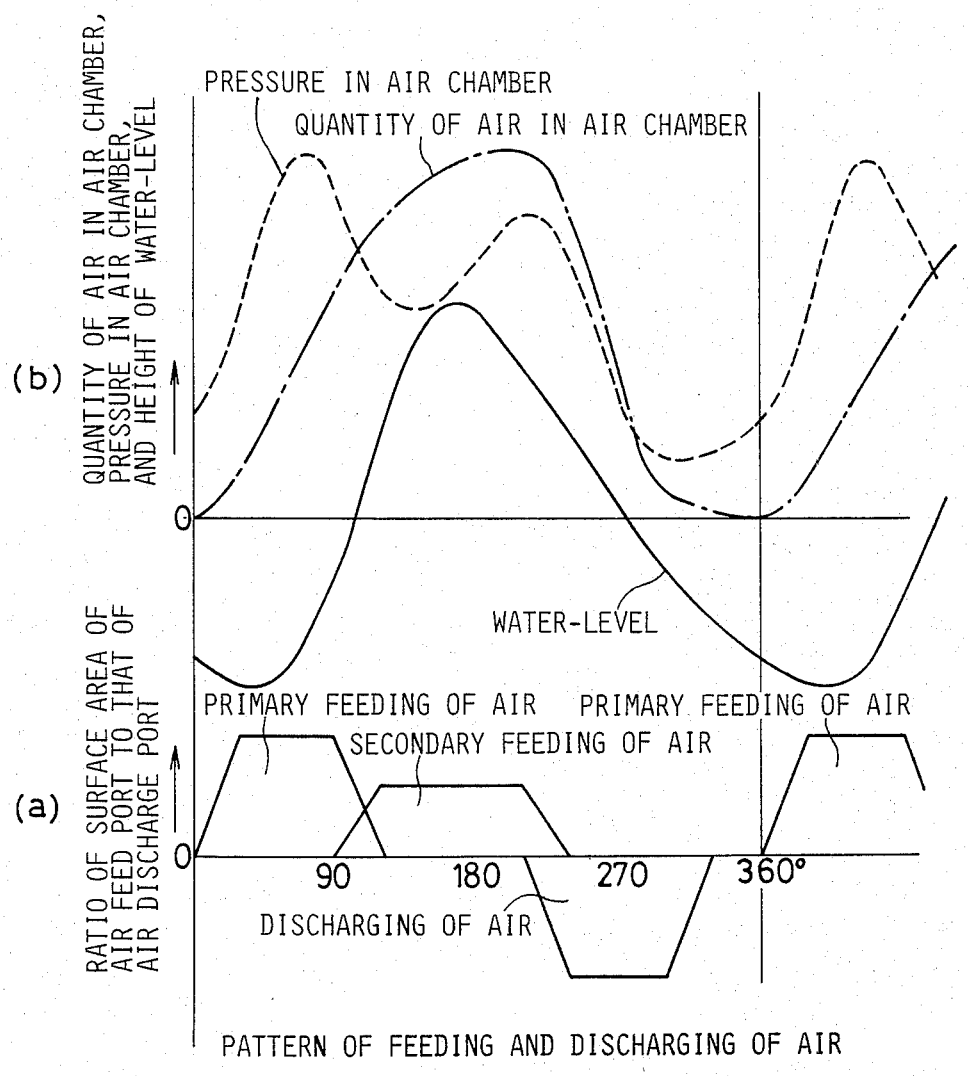
FIG. 20 at (*a*) is a graph showing the pattern of the feeding and discharging of air in the embodiment shown in FIGS. 16–19, and at (*b*) is a graph showing the distribution of pressure and quantity of air in the air chambers and variations in water-level with respect thereto.

Let $P_1$, $P_2$, $P_E$ and $P_C$ equal the pressure of air in a primary air feeding step, the pressure of air in a secondary air feeding step, the pressure of air being discharged and the pressure of air in the air chambers, respectively, for the convenience of the description of the relation therebetween. $P_1$ and $P_2$ are the pressures at the air supply sources, $P_E$ substantially equal to the atmospheric pressure, and $P_C$ the pressure in the air chambers, which is varied as shown in FIG. 20*b* in each cycle of operation of the apparatus. These pressures have the following relation. $P_1$>maximum $P_C$, and $P_2$>maximum $P_C$. $P_1$ and $P_2$ may have any of the relation, $P_1>P_2$, $P_1=P_2$, and $P_1<P_2$.

When the inner cylindrical casing 426 is rotated at a constant speed to cause the communication port 427 to be opposed to the primary feed port 422, the primary air flows into the inner casing 426 therethrough, then to the communication port 425 via both ends of the inner casing 426. The air then enters the air chambers 4 from the communication port 425 through the air pipes 9. When the inner casing 426 is further rotated, the communication port 427 and primary feed port 422 cease to be opposed to each other, so that the primary air stops being fed to the inner casing 426. After the primary air has stopped being fed to the inner casing, the communication port 527 and secondary feed port 424 are opposed to each other, so that the secondary air flows into the inner casing 426 therethrough. The air then flows to the communication port 425 via both ends of the inner casing 426 to enter the air pipes 9 therefrom.

The air flows from the air pipes 9 into the air chambers 4 to be incorporated into the primary air therein, so that the air chambers 4 are filled with a combination of the primary and secondary air.

When the inner casing 426 is further rotated, the communication port 527 ceases to be opposed to the secondary feed port 424. As a result, the secondary air stops being fed to the inner casing 426, and the communication port 427 is opposed to the discharge port 423 to be opened to the atmosphere. Consequently, the air in the air chambers 4 flows through the air pipes 9, communication port 425 and both ends of the inner casing 426 into the inner casing 426. The air is then discharged to the atmosphere through the communication port 427 and discharge port 423.

In this apparatus, the feeding of primary air, the feeding of secondary air and the discharging of the resulting air are carried out in the mentioned order and in an overlapping manner as shown in FIG. 20*a*. As a result, the pressure $P_C$ in the air chambers is increased and decreased as shown in broken line in FIG. 20*b*. Due to the variations in the pressure of the air in the air chambers, the water-level in the water tanks is increased suddenly at a slight phase lag as shown in full line in FIG. 20*b*. When the water level has then attained the heighest point, it is decreased gradually at a substantially constant rate. In order to allow the water-level in the water tanks to be increased suddenly and decreased gradually in the mentioned manner, it is necessary to control the pressure and flow rate of the air to be fed.

A curve drawn with a one-dot chain line in FIG. 20*b* represents the quantity of air in the air chambers, which is determined by multiplying the varying capacity of the air chambers by the varying air pressure, in which curve zero represents a minimum value.

According to the method of the present invention, the air is fed at a high flow rate into the large primary feed port to cause the quantity of air in the air chambers to be increased suddenly to a maximum level, so that the water-level in the air chamber is lowered suddenly due to the increased air pressure therein to allow the water-level in the water tanks to be increased suddenly. As the water-level in the water tanks is increased, the air pressure in the air chambers is decreased. While the water-level in the water tanks is increased, the small secondary feed port is opened to prevent a sudden decrease in the air pressure in the air chambers. Furthermore, while the water-level in the water tanks is decreased, the air continues to be fed into the secondary feed port to decrease the flow rate of the water flowing out of the water tanks.

Consequently, the water-level in the water tanks is decreased a little by little. During this time, the pulverulent body falls freely to be separated into lighter and heavier particles. The air in the chambers is thereafter discharged, and, therefore, the water-level in the water tanks is lowered not suddenly but gradually.

According to the method shown in this embodiment, the water-level in the water tanks is increased suddenly in one cycle of air feeding and discharging operation in the same manner as in each of the previously-described embodiments and the water-level therein is decreased gradually at a substantially constant rate, to thereby permit the pulverulent body to fall freely. This allows the pulverulent body-separating efficiency to be increased.

Furthermore, the primary and secondary feed ports in this embodiment are provided in the peripheral portions of different cross sections of the outer casing, and communication ports are provided in two portions of the inner casing. Accordingly, as shown in FIG. 20*a*, the pressure in the air chambers can be maintained until the primary and secondary feed ports have been opened in an overlapping manner for a short time, and the secondary feed port can be left opened in a short time after the discharge port has been opened. The time for opening the primary and secondary feed ports, and the secondary feed port and discharge port, in an overlapping manner can be increased or decreased by operating the slide gates. Therefore, the air feeding and discharging rates can be regulated easily, and ideal wave-forms thereof for the separation of a pulverulent body can be obtained easily.

The above suggests the provision of a third feed port and secondary and third discharge ports, which would permit the air feeding and discharging rates to be controlled more minutely.

Figure 21:
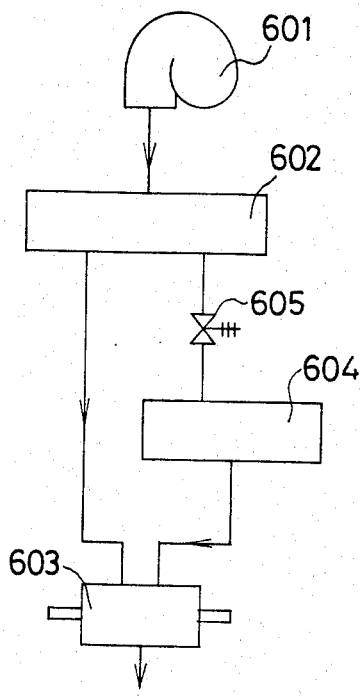
FIGS. 21 and 22 are block diagrams of pressure air feeding systems for the air feeding and discharging apparatus according to the present invention.
Figure 22:
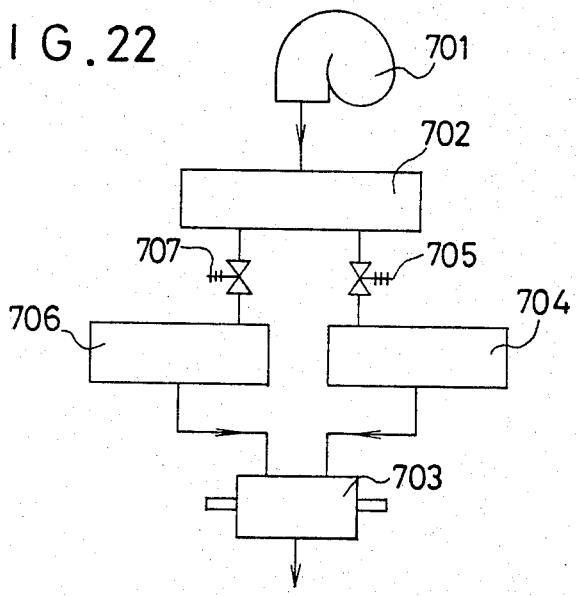

FIGS. 21 and 22 show further embodiments of the present invention, in which a blowing system for the apparatus for feeding and discharging air for pneumatic jigs is illustrated.

Referring to FIG. 21, reference numeral 601 denotes a blower, 602 a high-pressure air tank, 603 an air feeding and discharging apparatus (air feed valve), 604 a low-pressure air tank, and 605 a low-pressure reducing valve.

This blowing system consists of two passages, in one of which the air from the blower 601 is first sent to the high-pressure air tank 602, from which the air is sent to the air feeding and discharging apparatus 603 through the low-pressure reducing valve 605 and low-pressure air tank 604, and in the other of which the air from the blower 601 is first sent to the high-pressure air tank 602, from which the air is sent to the apparatus 603 directly.

FIG. 22 shows an embodiment consisting of a modification of the embodiment shown in FIG. 21. Referring to FIG. 22, reference numeral 701 denotes a blower, 702 an original-pressure air tank, 703 an air feeding and discharging apparatus, 704 a low-pressure air tank, 705 a low-pressure reducing valve, 706 a high-pressure air tank, and 707 a high-pressure reducing valve. The pressure in the original-pressure tank 702 is set to a level higher than that of the pressure in the high-pressure tank 706. It is necessary that the blower 701 has a larger capacity than the blower 601 in the embodiment shown in FIG. 21.

This blowing system consists of two passages, in one of which the air from the blower is first sent to the original-pressure air tank 702, from which the air is sent to the air feeding discharging apparatus 703 through the low-pressure reducing valve 705 and low-pressure air tank 704, and in the other of which the air from the blower is first sent to the original-pressure tank 702, from which the air is sent to the apparatus 703 through the low-pressure reducing valve 707 and high-pressure air tank 706.

Each of the air feeding and discharging apparatuses 603, 703 shown in FIGS. 21 and 22 has integrally-formed low and high pressure portions. The low and high pressure portions may be separately formed.

In the arrangements shown in FIGS. 21 and 22, only one blower may be used sufficiently. This allows the equipment cost to be minimized, and the operating power to be saved.

We claim:

1. A method of feeding and discharging air for pneumatic jigs to separate a pulverulent body in the jig, having the steps of feeding and discharging pressure air to and from air chambers, which are opened at their respective lower ends, and which are formed in water-filled tanks, to vertically vibrate water in the water tanks, and thereby separate the pulverulent body, comprising a plurality of steps of feeding air of different pressure to said air chambers during one cycle of operation, said plurality of feeding steps comprising an initial high pressure feeding step followed by at least one lower pressure feeding step, and a single step of discharging feed air from said air chambers during said one cycle, said air feeding steps being carried out at the same frequency and said air discharging step and air feeding steps being carried out repeatedly for a plurality of said one cycle so that a water level in each water tank rises rapidly and falls gradually for each cycle.

2. A method of feeding and discharging air for pneumatic jigs according to claim 1, wherein said air feeding steps and said air discharging step have overlapping periods.

3. An apparatus for feeding and discharging air for pneumatic jigs, in which pressure air is fed and discharged to and from air chambers, which are opened at their respective lower ends, and which are formed in water-filled tanks, to vibrate water in said water tanks and thereby separate a pulverulent body, comprising: an outer cylindrical casing; an inner casing provided rotatably in said outer casing; said outer casing being provided in a circumferential wall thereof with a communication port communicated with air pipes opened into said air chambers, a plurality of air ports, and a discharge port; and air feeding means communicating with said plurality of air ports for feeding air of a plurality of different pressures to said air ports; said inner casing having at least one communicating port for communication with said air ports and discharge port, and means for said inner casing to communicate with said communication port of said outer casing.

4. An apparatus for feeding and discharging air for pneumatic jigs according to claim 3, wherein said plurality of air ports and said discharge port are provided in a circumferential wall of said outer casing in such manner that said air ports and discharge port are spaced from one another in the direction of an axis of said outer casing, said inner casing being provided with communication ports in those portions of a circumferential wall of said inner casing which correspond to said air ports and discharge port and which are spaced in the direction of an axis of said inner casing.

5. An apparatus for feeding and discharging air for pneumatic jigs according to claim 4, wherein said air ports, said discharge port and said communication ports are so arranged as to allow said air feeding and discharging steps to have overlapping periods.

6. An apparatus for feeding and discharging air for pneumatic jigs according to claim 4, wherein said plural air ports and said discharge port are provided in the circumferential wall of said outer casing in such a manner that these ports are aligned with one another in the direction of the axis thereof, said communication ports being provided in those portions of said inner casing which correspond to said air ports and said discharge port and which are spaced in the direction of the circumference thereof.

7. An apparatus for feeding and discharging air for pneumatic jigs according to claim 3, wherein said air feeding means includes a tank for storing high-pressure air, means for sending high-pressure air to said air tank, a plurality of air feed pipes connected to said air tank, a pressure regulating valve provided in at least one of said air feed pipes, and another air tank provided on a downstream side of said pressure regulating valve, said air feed pipes being connected at their respective ends to said air ports provided in said outer casing of said apparatus.

8. An apparatus for feeding and discharging air for pneumatic jigs, in which pressure air is fed and discharged to and from air chambers, which are opened at their respective lower ends, and which are formed in water-filled tanks, comprising a plurality of outer cylindrical casings, communication ports provided in circumferential walls of said outer casings and communicated with air pipes opened into said air chambers, a discharge port provided in the circumferential wall of one of said outer casings, air ports provided in the circumferential walls of said outer casings and communicated with an air feeding means, inner cylindrical casings provided rotatably in said outer casings and operatively connected to one another, the interior of each of which inner casings is communicated with the corresponding communication ports, and communication ports provided in circumferential walls of said inner casings for communicating with said air ports and said discharge port.

9. An apparatus for feeding and discharging air for pneumatic jigs according to claim 8, wherein said air feeding means includes a tank for storing high-pressure air, means for sending high-pressure air to said air tank, a plurality of air feed pipes connected to said air tank, a pressure regulating valve provided in at least one of said air feed pipes being connected at their respective ends to said air ports provided in said outer casing of said apparatus.

* * * * *

UNITED STATES PATENT OFFICE

CERTIFICATE OF CORRECTION

Patent No. 4,508,620 Dated April 2, 1985

Inventor(s) Najima et al

It is certified that error appears in the above-identified patent and that said Letters Patent are hereby corrected as shown below:

On the title page:

Name of assignee indicated as "Mitsubishi Jukogyo Kabushiki Kaisha" should read as follows:
--Mitsubishi Jukogyo Kabushiki Kaisha and Ryonichi Engineering Kabushiki Kaisha, Japan--.

Signed and Sealed this

Seventeenth Day of December 1985

[SEAL]

Attest:

DONALD J. QUIGG

Attesting Officer

Commissioner of Patents and Trademarks